United States Patent [19]

Keiner

[11] Patent Number: 4,610,476

[45] Date of Patent: Sep. 9, 1986

[54] CARRYING STRAP MOUNTING

[75] Inventor: Heinz Keiner, Solms, Fed. Rep. of Germany

[73] Assignee: Ernst Leitz Wetzlar GmbH, Wetzlar, Fed. Rep. of Germany

[21] Appl. No.: 623,458

[22] Filed: Jun. 22, 1984

[30] Foreign Application Priority Data

Jun. 25, 1983 [DE] Fed. Rep. of Germany ... 8318443[U]

[51] Int. Cl.[4] ..... A63C 11/02

[52] U.S. Cl. ..... 294/149; 293/151; 293/153

[58] Field of Search ..... 294/149, 150, 151, 153, 294/74, 31.2; 24/3 B, 298, 300, 588

[56] References Cited

U.S. PATENT DOCUMENTS 3,294;299 12/1966 Brennan ..... 294/149

FOREIGN PATENT DOCUMENTS 2305210 3/1974 France ..... 294/149

*Primary Examiner*—James B. Marbert

*Attorney, Agent, or Firm*—Schwartz, Jeffery, Schwaab, Mack, Blumenthal & Evans

[57] ABSTRACT

Disclosed is a carrying strap mounting for the releasable mounting of a terminal loop on a carrying strap on the mounting lug, for example, of binoculars by means of a flexible cord loop. The flexible cord loop is connected on one end directly with the mounting lug and at the other end is releasably connected with a single piece fastening element. The fastening element is hooked into the loop of the carrying strap and is secured with a locking slide. Both the cord loop and the fastening element preferably comprise a synthetic resin material.

11 Claims, 2 Drawing Figures

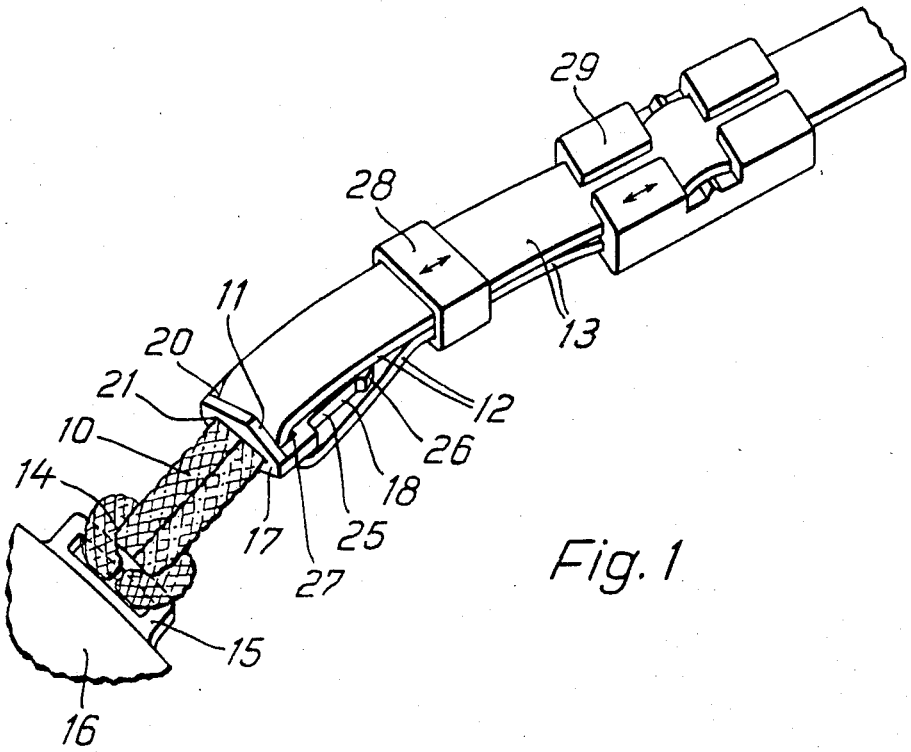
Fig. 1
Fig. 2
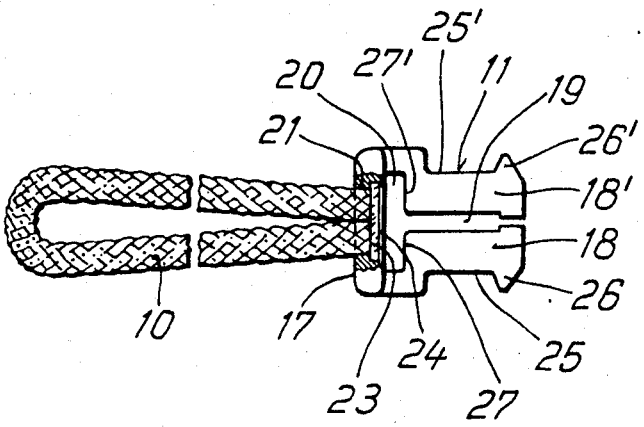

CARRYING STRAP MOUNTING

BACKGROUND OF THE INVENTION

The present invention relates to a carrying strap mounting for the releasable fastening of a terminal loop of a strap to a carrying lug, for example, for binaculars or a camera, with a locking slide surrounding said carrying strap.

German Offenlegungsschrift No. 30 27 818 discloses a carrying strap mounting which comprises an elastic mount made of metal having two S shaped mounting components facing each other. The lower, outwardly bend ends thereof are attached to a bow-shaped eyelet part. The eyelet part is hooked onto the mounting lug of an object, for example, a camera. The rigid metal mount is surrounded directly by the mounting lug.

SUMMARY OF THE INVENTION

It is an object of the present invention to provide a carrying strap mount for the releasable fastening of a strap to a mounting lug which may be easily attached without rubbing against it or hooking into the object to be carried.

It is another object of the present invention to provide a mounting as above, wherein noise due to metal-metal contact is avoided.

In accomplishing the foregoing objects, there has been provided in accordance with the present invention a carrying strap mounting for the releasable fastening of a terminal loop of a carrying strap to a mounting lug. The strap mount comprises a one-piece fastening element having an opening for removably receiving the loop of the carrying strap, a flexible cord loop attached to one end of the fastening element, and a slideable locking member disposed around the carrying strap and being adapted to cooperate with said fastening element when slid thereover to secure the strap within the opening of the fastening element. The fastening element may take the form of a modified U-shaped structure wherein the base is provided with an opening to accept the flexible cord, the legs extend from the base such that a substantially rectangular opening is defined near the base to receive the terminal loop of the carrying strap, and the outer surfaces of the legs are provided with notches to receive the slideable locking member. The two ends of the flexible cord may be attached to a plate which fits into a recess provided on one surface of the base to ensure that the cord loop and fastening element are not pulled apart.

Further objects, features and advantages of the present invention will become apparent from the detailed description of preferred embodiments which follows, when considered together with the attached figures of drawing.

BRIEF DESCRIPTION OF THE DRAWINGS

In the drawings:

FIG. 1 is a perspective view of a carrying strap mount according to the invention, and FIG. 2 shows a partially sectioned, top view of a fastening element with a cord loop according to the present invention.

DETAILED DESCRIPTION OF PREFERRED EMBODIMENTS

The present invention provides a carrying strap mount wherein the mounting has a flexible cord loop, which is connected on one end directly with the mounting lug and is connected with said carrying strap at the other end by means of a single piece fastening element which hooks into the loop of the carrying strap.

Further details of the invention will be found in the following description of an exemplary preferred embodiment shown schematically in the drawing.

The carrying strap mount shown in FIGS. 1 and 2 comprises a flexible cord loop 10 deformable in all directions, but not elastic in the longitudinal direction, and a fastening element 11, which in FIG. 1 is partially obscured by a carrying strap 13 forming the terminal loop 12. The cord loop 10 is connected directly by means of its loop shaped terminal section with a mounting lug 15 of an object 16, for example, binoculars, while forming a noose 14.

As seen in particular in FIG. 2, the fastening element 11 has the approximate shape of a U and is provided with a broadened, essentially rigid base surface 17 and two legs 18, 18', with a gap 19 between said legs, so that they may be compressed elastically. The legs 18, 18' are angled in the area of the base surface 17, whereby a rectangular opening 20 is created to receive the loop 12 of the carrying strap 13. The base surface 17 of the fastening element 11 is provided with a passage 21 for the cord loop 10. The two ends of the cord loop opposite the loop shaped section are fastened to a plate 23, for example by vulcanizing or pressing. For a releasable connection of the cord loop 10 with the fastening element 11, the loop shaped section of the cord loop 10 is passed through the passage 21 of the base surface 17 of the fastening element 11 and slightly tightened. The plate 23 is contained in a recess 24 provided in the side of the base surface 17 of the fastening element 11 facing the opening 20. It is evident that the cord loop 10 may also be connected fixedly with the base surface of the fastening element 11, for example, by vulcanizing.

Each of the two legs 18, 18' has on its outer side a rectangular locking notch 25, 25', formed in the area of the free legs 18, 18' by means of the triangular projections 26, 26' and in the area of the base surface 17 by means of the angular portion of the legs 18, 18' themselves. The distance between the bottom surfaces of the notches 25, 25' in the unmounted state of the fastening element 11 is slightly larger then the width of the carrying strap 13.

To fasten the carrying strap 13 to the mounting lug 15 of an object 16, the cord loop 10 is initially connected with the fastening element 11 in the above-described manner. The loop shaped section of the cord loop 10 is then passed through the mounting lug 15 and the fastening element 11 through the double cord loop. The fastening of the carrying strap 13 to the fastening element 11 is effected by inserting the loop 12 of the carrying strap 13 into the gap 19 between the legs 18, 18' of the fastening element 11 and moving the loop 12 to the opening 20. The loop 12 received by the opening 20 is then in contact under tension with the inner angles 27, 27' forming the legs 18, 18' as part of the opening 20. To secure the arrangement, a locking slide 28 surrounding the carrying strap 13 on all sides is slid over the outwardly directed projections 26, 26' of the legs 18, 18' of the fastening element 11, which are thereby pressed inwardly, until the notches 25, 25' receive the locking slide 28, thereby preventing the unintentional displacement of the latter. Finally, for the longitudinal adjustment of the carrying strap 13 after fastening, a known adjusting element 29 is provided.

The fastening element 11 comprises a single injection molded part of a synthetic plastic material, for example, polyoxymethylene. Polyamides are particularly suitable as the material for the cord loop 10, but other high strength fiber materials are also conceivable.

What is claimed is:

1. A carrying strap mounting for the releasable fastening of a first terminal loop of a carrying strap to a mounting lug on an object to be carried, comprising:

a one-piece fastening element having an opening for removably receiving the first loop of the carrying strap;

a second flexible cord attached to one end of the fastening element and adapted to be connected at the other end with the mounting lug;

a slideable locking member disposed around the carrying strap and being adapted to cooperate with said fastening element when slid thereover to secure the strap within said opening in the fastening element; and wherein the fastening element comprises an essentially rigid base member, including means for attaching the second cord loop, and two elastic legs attached in spaced relationship to said base member to form a generally U-shaped configuration, wherein the legs are angled in the area of the base member to form an opening for accepting the first loop of the carrying strap.

2. A carrying strap mounting according to claim 1, wherein each of the legs is provided with a locking notch on its outer side and the normal distance between the bottom surfaces of the notches is slightly larger than the width of the carrying strap.

3. A carrying strap mounting according to claim 1, wherein the second cord loop is releasably connected with the fastening element.

4. A carrying strap mounting according to claim 1, wherein the second cord loop comprises a synthetic resin material having a high tensile strength and abrasion resistance.

5. A carrying strap mounting according to claim 4, wherein the synthetic resin material comprises a polyamide.

6. A carrying strap mounting according to claim 1, wherein the fastening element comprises an injection molded synthetic resin part.

7. A carrying strap mounting according to claim 6, wherein the fastening element comprises polyoxymethylene.

8. A carrying strap mounting according to claim 1, wherein said means for attaching the cord loop comprises a passage through the base member for the cord loop and wherein one surface of the base member is provided with a recessed area surrounding the passage for the cord loop.

9. A carrying strap mounting according to claim 9, further comprising a plate to which two ends of the flexible cord forming the cord loop are attached, and wherein the plate is disposed in the recessed area of the base member.

10. A carrying strap mounting according to claim 1, further comprising means, including an adjusting element disposed on the carrying strap, for adjusting the length of the carrying strap.

11. A carrying strap mounting for the releasable fastening of a first terminal loop of a carrying strap to a mounting lug on an object to be carried, comprising:

a one-piece fastening element having an opening for removably receiving the first loop of the carrying strap;

a second flexible cord loop attached to one end of the fastening element and adapted to be connected at the other end with the mounting lug;

a slideable locking member disposed around the carrying strap and being adapted to cooperate with said fastening element when slid thereover to secure the strap within said opening in the fastening element; and wherein the fastening element comprises a modified U-shaped structure wherein the base of the U-shape is provided with an opening to accept the second flexible cord, the legs of the U-shape extend from the base in such a manner that a substantially rectangular opening is defined near the base to receive the first terminal loop of the carrying strap, and the outer surfaces of the legs are provided with notches to receive the locking member.

* * * * *